US005486991A

United States Patent [19]

Bodem, Jr.

[11] Patent Number: 5,486,991

[45] Date of Patent: Jan. 23, 1996

[54] VEHICLE SIGNAL LAMP ASSEMBLY

[75] Inventor: Jack D. Bodem, Jr., Kokomo, Ind.

[73] Assignee: Federal-Mogul Corporation, Southfield, Mich.

[21] Appl. No.: 283,105

[22] Filed: Jul. 29, 1994

[51] Int. Cl.[6] ..... F21V 15/04

[52] U.S. Cl. ..... 312/369; 312/390; 312/61; 312/288; 439/619; 439/679.1; 439/558

[58] Field of Search ..... 362/369, 390, 362/306, 288, 226; 439/619, 602, 699, 558; 248/618, 605

[56] References Cited

U.S. PATENT DOCUMENTS

| | | | |
|---|---|---|---|
| 2,781,443 | 2/1957 | Cargle . | |
| 3,059,104 | 10/1962 | Dickson . | |
| 3,115,307 | 12/1963 | Dickson . | |
| 3,145,933 | 8/1964 | Dickson . | |
| 3,208,031 | 9/1965 | Dickson . | |
| 3,222,512 | 12/1965 | Dickson . | |
| 3,327,110 | 6/1967 | Baldwin . | |
| 3,534,321 | 10/1970 | Malachowski . | |
| 3,676,834 | 7/1972 | Kaldor et al. . | |
| 3,980,878 | 9/1976 | Crompton . | |
| 4,070,567 | 1/1978 | Crompton | 362/390 |
| 4,118,764 | 10/1978 | Bleiweiss et al. | 362/369 |
| 4,176,391 | 11/1979 | Kulik et al. | 362/390 |
| 4,231,081 | 10/1980 | Borruso | 362/390 X |
| 4,282,566 | 8/1981 | Newman | 362/369 |
| 4,390,936 | 6/1983 | Salter, Jr. et al. | 362/390 |
| 4,593,958 | 6/1986 | Baba | 439/558 X |
| 4,797,111 | 1/1989 | Ackmann | 439/755 |
| 4,804,343 | 2/1989 | Reedy | 439/699 |
| 4,957,455 | 9/1990 | Horiuchi et al. | 439/558 X |
| 5,000,702 | 3/1991 | Forish et al. | 439/699 |

*Primary Examiner*—Ira S. Lazarus
*Assistant Examiner*—Thomas M. Sembers
*Attorney, Agent, or Firm*—Lawrence J. Shurupoff

[57] ABSTRACT

A vehicle signal lamp assembly includes lamp filaments extending in a direction generally parallel to the line of action of the principal vibratory force imposed on the lamp assembly. The assembly includes a lamp having a base that mounts two or more pairs of relatively stiff filament support wires. The lamp assembly further includes a socket having a cavity mated to the cross sectional configuration of the lamp base, and resilient electrical contact leaf members in the cavity engageable with the filament support wires when the lamp base is plugged into the socket cavity. The socket is carried in a resilient mounting that provides partial shock isolation for the socket and lamp.

8 Claims, 4 Drawing Sheets

FIG 1
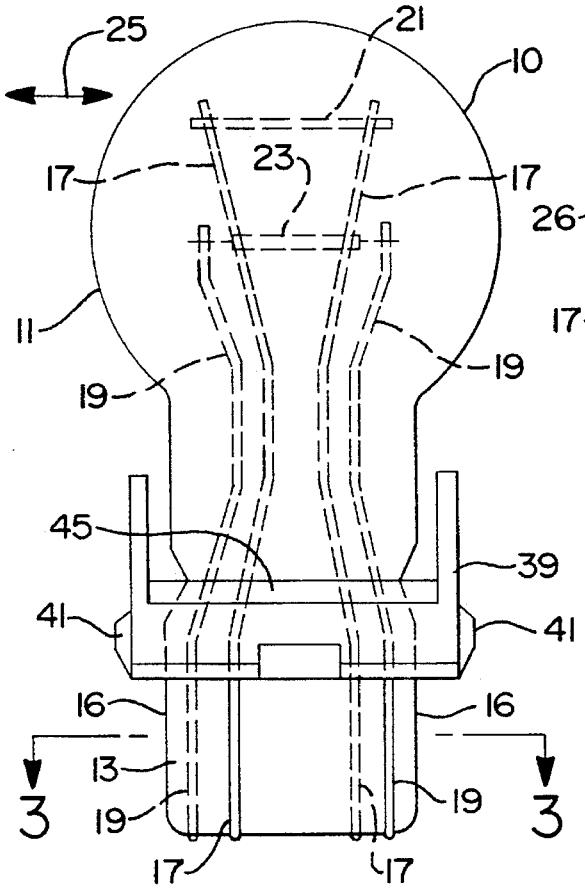
FIG 2
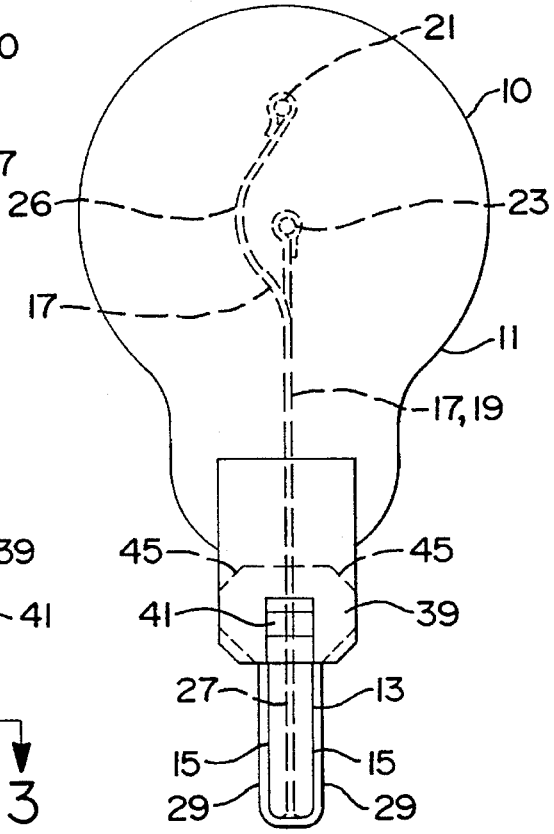
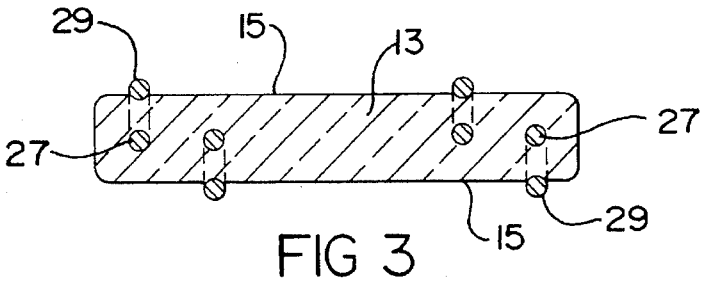
FIG 3

FIG 4
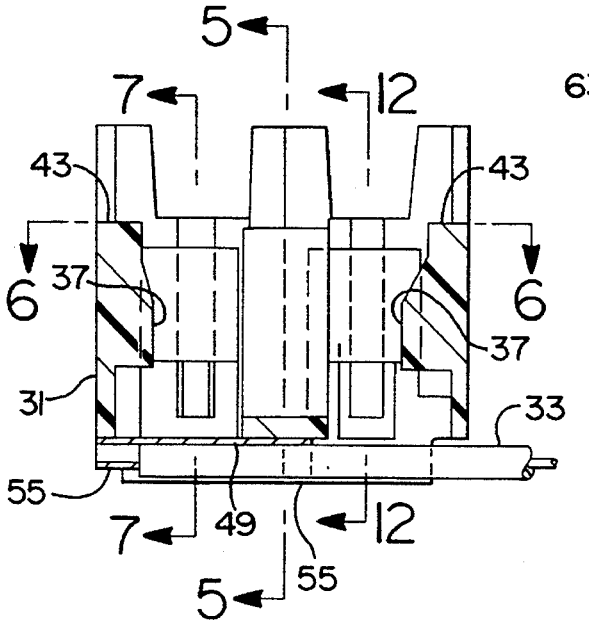
FIG 5
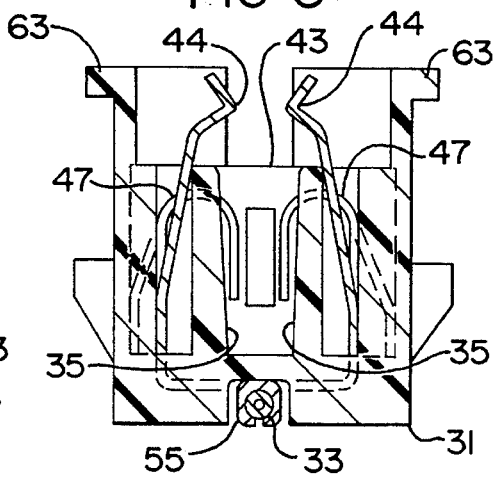
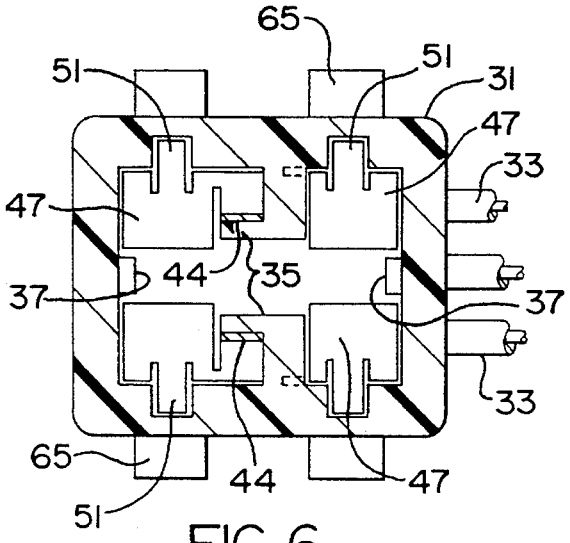
FIG 6
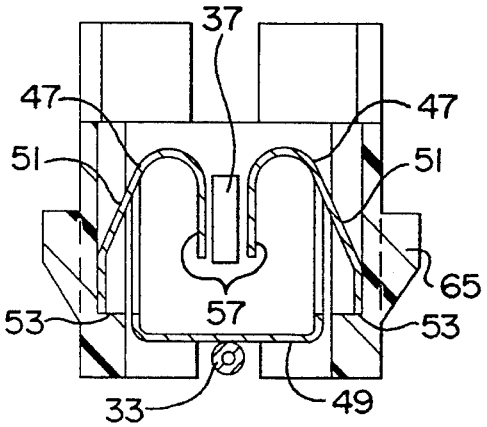
FIG 7

FIG 8
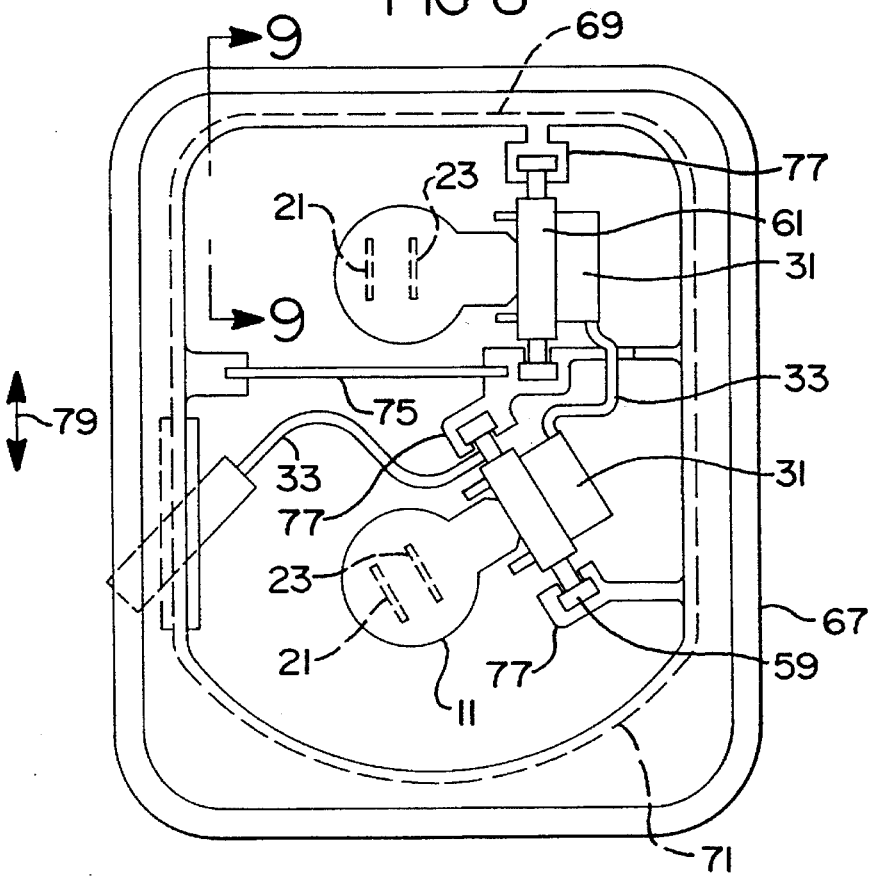
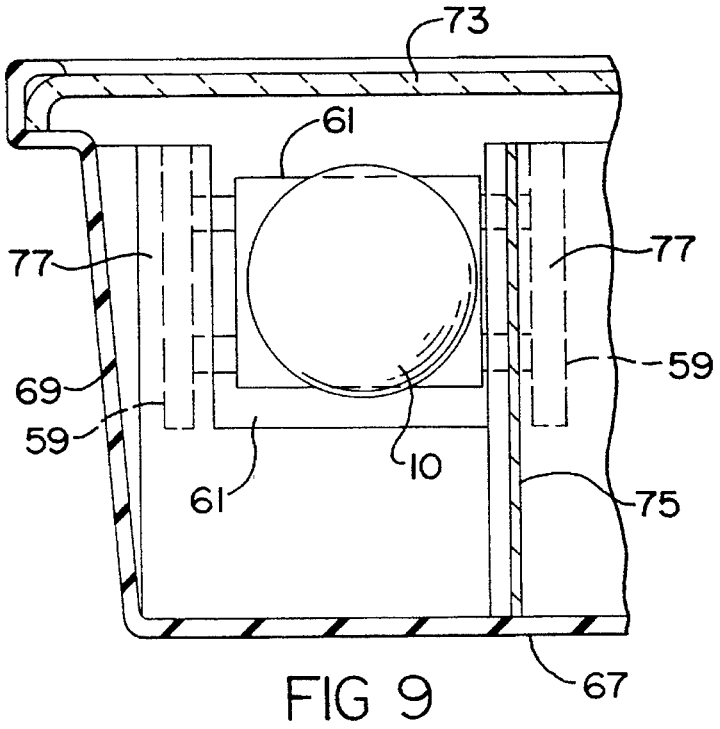
FIG 9

FIG 10
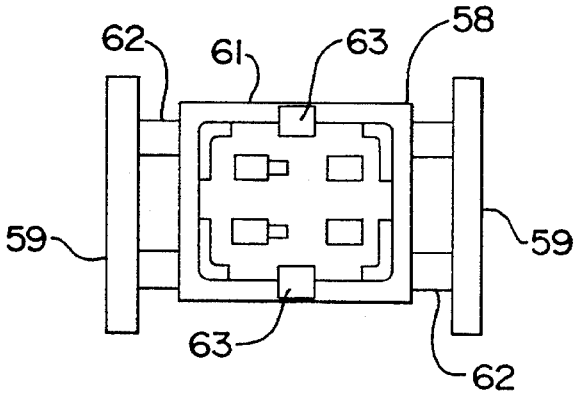
FIG 11
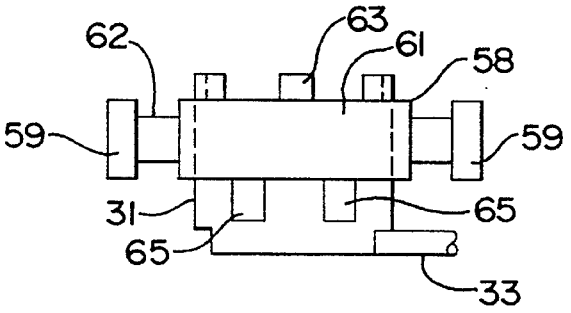
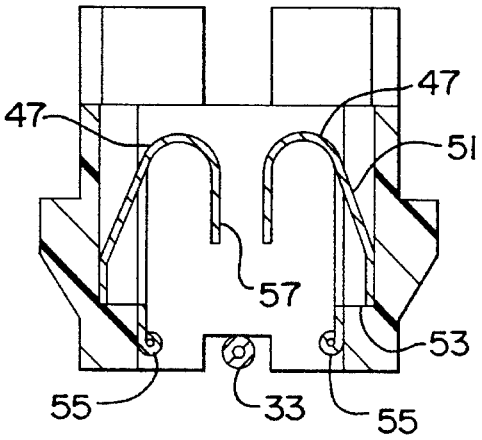
FIG 12
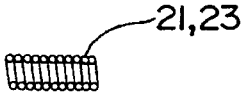
FIG 13

VEHICLE SIGNAL LAMP ASSEMBLY

BACKGROUND OF THE INVENTION

1. Field of the Invention

The present invention relates to vehicle signal lamp assemblies, and particularly to such lamp assemblies having a resilient bulb mount for absorbing road shock forces associated with vehicle movement.

2. Description of Prior Developments

Vehicle signal lamp assemblies, such as brake lights, back-up lights and turn signal lights tend to fail prematurely when exposed to excessive road shock forces. Various resilient shock absorption mounts have been developed for shielding the lamp filaments from such road shock forces. U.S. Pat. No. 4,176,391 to Kulik includes a discussion of some of the resilient shock absorption lamp mounting devices that have been proposed.

U.S. Pat. No. 4,176,391 discloses a shock isolating vehicle lamp assembly wherein a signal lamp has a cylindrical metal base inserted into a cylindrical metal socket that is embedded in a rubber block constituting part of a shock isolation mount for the lamp bulb. Two pairs of arms extend in opposite directions from the rubber block to connect with two rectangular support bars. The support bars are fixedly mounted in two horizontal tracks in the lamp housing so that the lamp central axis is vertical.

Vehicle vibrational forces act primarily in the vertical direction so that the support bars oscillate vertically. The connecting arms between the support bars and the rubber block flex in transverse directions, i.e. vertically, so that the rubber block and associated lamp are stabilized against excessive vertical oscillation.

In the arrangement of U.S. Pat. No. 4,176,391, the filaments in the lamp are horizontally oriented. Therefore, any vertical oscillatory motion of the lamp will subject the filaments to transverse bending forces. The relatively thin filament wires are not resistant to such bending forces. It is believed that the filament orientation transverse to the direction of the principle vibratory force can contribute to premature lamp failures.

SUMMARY OF THE INVENTION

The present invention relates to a resiliently mounted vehicle signal lamp assembly wherein the lamp is oriented so that its filaments extend approximately parallel to the line of action of the principle vibratory forces exerted against a resilient lamp mounting. In most vehicle applications, the lamp filaments extend vertically so as to be in line with vertical road shock forces. By orienting the lamp filaments in particular directions, e.g., vertically, the lamp filaments become resistant to road shock forces.

The invention includes a shock resistant lamp assembly, wherein the shock resistance is developed by the combination of a resilient lamp mount and a particular orientation of the lamp filaments. Additional resilience is provided to the lamp mount by electrical contact arms which supply the lamp with electrical current. The contacts are formed as leaf springs which are biased against the base of the lamp so as to allow limited spring biased movement of the lamp within its mounting socket.

BRIEF DESCRIPTION OF THE DRAWINGS

In the drawings:

FIG. 1 is a front elevational view of a vehicle signal lamp used in a lamp assembly constructed according to the invention.

FIG. 2 is a side elevational view of the FIG. 1 lamp.

FIG. 3 is an enlarged sectional view taken through line 3—3 of the FIG. 1 lamp.

FIG. 4 is a sectional view taken through a socket usable to mount the FIG. 1 lamp.

FIG. 5 is a sectional view taken through line 5—5 in FIG. 4.

FIG. 6 is a sectional view taken through line 6—6 in FIG. 4.

FIG. 7 is a sectional view taken through line 7—7 in FIG. 4.

FIG. 8 is an elevational view of a pair of lamp assemblies of the present invention installed in a protective housing. The lens used on the housing is removed to better illustrate the lamp assemblies.

FIG. 9 is an enlarged fragmentary sectional view taken through line 9—9 in FIG. 8.

FIG. 10 is a plan view of an assembly comprising the FIG. 4 socket means and an associated resilient mounting means.

FIG. 11 is a side elevational view of the FIG. 10 assembly.

FIG. 12 is a sectional view taken through line 12—12 in FIG. 4.

FIG. 13 fragmentarily illustrates a coil-type lamp filament useful in practice of the invention.

DETAILED DESCRIPTION OF THE PREFERRED EMBODIMENTS

FIGS. 1 and 2 show a vehicle signal lamp 10 that includes a glass housing having a hollow thin-walled bulb 11 and a flat, generally rectangular or spade-shaped base 13 integral with the bulb. Base 13 has two generally flat major side surfaces 15 extending parallel to the base mid-plane. Bulb 11 has a somewhat spherical shape.

Two pairs of relatively stiff filament support wires 17,19 are embedded in base 13 so as to extend within the hollow bulb. Each filament support wire 17,19 is located in the midplane of base 13, as depicted in FIG. 2. A light-producing filament 21,23 is trained between the wires 17,19 within bulb 11 such that each support wire serves as a current conductor for the associated filament.

Each filament includes a thin fragile wire formed into a tight helical coil so that adjacent convolutions of the coil are in contact with each other. FIG. 13 shows, in a greatly magnified scale, a fragmentary portion of a representative coil configuration that can be used for the filament. The coil exhibits relatively good columnar strength in the direction along the longitudinal coil axis as designated by numeral 25 in the drawings.

Each filament 21,23 is located in a plane coincident with the common plane of support wires 17,19 as shown in FIG. 2. Upper end portions of support wires 17 are V-shaped or curved, as at 26, to provide a desired clearance with respect to filament 19.

Each support wire 17,19 has a U-shaped mounting portion embedded in molded glass base 13 so that one leg of the U is enclosed within the base and the other leg of the U is exposed along a flat major side surface 15 of the base. In FIG. 3, the enclosed portion of the U-shaped wire section is designated by numeral 27 and the exposed portion of the U-shaped wire section is designated by numeral 29. The U-shaped sections are offset from the midplane of base 13 in different directions so that the base can be oriented with either side surface 15 facing a given direction in the socket of FIGS. 4 through 7.

FIGS. 4 through 7 illustrate a dielectric socket 31 having a cavity formed therein for receiving lamp base 13. The lamp base 13 can be plugged into the socket 31 to establish electrical connections between support wires 17,19 and lead wiring 33 attached to the socket. Each lead wire is a flexible electrical conductor encased within a plastic dielectric sheath.

Socket 31 includes a one-piece rigid enclosure formed of a nonconducting plastic material. Internal side surfaces of the plastic enclosure are matable with the surfaces of lamp base 13, so that the lamp base seats firmly in the cavity without looseness or play. A secure fit of base 13 within socket 31 is most important to protect against electrical arcing. A first pair of internal side wedge surfaces 35 of the plastic enclosure mate with the major side surfaces 15 of the lamp base, whereas a second pair of internal side wedge surfaces 37 of the plastic enclosure mate with the minor end surfaces 16 of the lamp base to form a snug fit of the base in the cavity.

Side surfaces 35 serve as wedges to firmly secure lamp base 13 within socket 31. Surfaces 37 prevent side to side movement of lamp base 13. The upper mouth areas of the cavity surfaces 35,37 are flared, as shown in FIGS. 4 and 5, to facilitate guidance and easy entry of the lamp base during its insertional motion into the socket cavity.

Downward insertional motion of the lamp base into the socket cavity is limited by an annular plastic collar 39 (FIG. 1) affixed to the lamp base. When the lamp base is inserted into the socket, lugs 41 abut socket surfaces 43 to limit downward motion of the lamp base. Simultaneously, two resilient snap-action spring detents 44 carried by the socket grip the upper surfaces 45 (FIGS. 1 and 2) of the collar 39 to prevent easy escape of the lamp base from the socket cavity. The strength of the detent action is related to the resilience and stiffness of the spring detent leaf arms. Collar surfaces 45 are inclined to permit upward pullout of the lamp from the socket by a suitable upward manual pull of the lamp.

Socket 31 contains leaf spring electrical contacts within the socket cavity for engagement with the exposed portions 29 of filament support wires 17. As shown in FIG. 7, the electrical contacts include two U-shaped resilient contact lead elements 47 integral with a web wall 49. Copper strip material may be used to form the leaf elements and associated web wall 49. The strip material can be cut and blanked to form resilient latch arms 51. Each latch arm has a distal end engageable with an internal shoulder 53 in socket 31 to prevent downward dislocation of the electrical contacts out of the socket cavity. As shown in FIGS. 5 and 6, the detents 44 are formed out of the same strip material that forms contact leaf spring elements 47.

FIG. 12 shows two electrical contact leaf spring members formed separately from each other, but otherwise similar to the contact structure depicted in FIG. 7. The contacts depicted in FIGS. 7 and 12 are attached to their respective lead wires 33 by crimping lower areas 55 of the metal strips around the associated wires and insulated sheaths.

The lead wires 33 are attached to the respective electrical contacts prior to installation of the contacts into the socket cavity. Each electrical contact is installed in the socket cavity by manually inserting the contact upwardly through the lower open end of socket 31, such that latch arms 51 deflect inwardly and then snap laterally outwardly into engagement with shoulders 53. The respective lead wires 33 extend transversely across the lower open end of the socket cavity to prevent upward dislocation of the attached electrical contacts through the cavity mouth.

Each U-shaped contact leaf 47 includes a resilient deflectable arm 57 located in the insertional path of the lamp base so that, when the lamp is plugged into the socket cavity, each contact arm 57 is deflected into a biased pressure contact with an associated filament support wire 17,19. The electrical contacts provide electrical connections between support wires 17,19 and lead wiring 33 and further provide a resilient mounting for lamp base 13 allowing limited, resiliently biased front-to-back movement of the lamp 10 within socket 31.

FIGS. 10 and 11 show a resilient one-piece mounting 58 for the rigid plastic socket 31. The resilient mounting includes two parallel anchorage bars 59, a rectangular collar 61 located midway between bars 59, and multiple compressible cylindrical struts 62 extending between the jacket and the bars.

Collar 61 forms a flexible collar or sleeve fitting around the external side surface of socket 31. Flanges 63 and lugs 65 on the socket retain the socket within the grip of collar 61. Compressible struts 62 support the collar and socket 31 in spaced relation to anchorage bars 59.

The resilient mounting which includes bars 59, struts 62 and collar 61 is molded as a one-piece elastomeric molding to provide at least partial shock isolation for the lamp socket, i.e. isolation from road shock forces imposed on anchorage bars 59.

FIGS. 8 and 9 show a molded elastomeric lamp housing 67 for containing two lamp assemblies of the type depicted in FIGS. 1 through 7 and 10 through 12. FIG. 8 shows housing 67 in an upright condition, as it would be on the vehicle with wall 69 of the housing constituting the top wall, and wall 71 constituting the bottom wall. Wall 71 is transparent so that light from the lowermost lamp 10 shines downwardly through wall 71 to serve as a vehicle back-up light. The uppermost lamp 10 can serve as a brake light and as a turn signal. A colored lens 73 (FIG. 9) extends across the mouth of housing 67 to provide a signal light of a desired color. A partition 75 in the housing optically separates the two lamps.

Each lamp assembly is mounted in the housing 67 by two horizontal tracks or grooves 77, preferably molded integrally with the lamp housing walls. Each lamp assembly is installed in housing 67 by sliding the resilient mounting 58 horizontally into the housing, such that anchorage bars 59 enter into the tracks 77.

In FIG. 8, the direction of the principle vibratory force imposed on mounting 58 is designated by numeral 79. Usually, vibration forces will be vertical to correspond with the up-and-down motion of the vehicle resulting from travel over uneven surfaces, e.g., road bumps and terrain irregularities.

The upper lamp assembly is oriented in housing 67 so that filaments 21,23 have their length dimensions 25 oriented in the line of action of the principle vibratory force, i.e. force line 79. Filaments 21,23 are of coil-like construction so as to be relatively strong along the coil axis, coincident with direction line 25. By orienting the lamp so that filaments 21,23 are in parallelism with the line of action of the vibratory force, the lamp filament life can be increased. The lamp filaments are shielded from transverse bending forces that could produce early fatigue failure of the filament wire.

In FIG. 8, the lower lamp assembly is oriented so that the lamp filaments are at a relatively slight angle to the vibratory force line 79. The lamp filament wires are thus largely free from transverse bending forces that could produce early fatigue failure.

The vehicle signal lamp assembly shown in the drawings is designed to prevent early failure of the filament wires. Resilient mounting 58 provides partial shock isolation of the socket 31 and lamp 10. The lamp filaments are further protected against vibratory shock forces because of the orientation of the filaments in the line of action of the principle vibratory force, or at a relatively slight angle to the vibratory force line of action, as depicted in FIG. 8.

In preferred practice of the invention, the lamp base 13 has a flat, rectangular or spade shape such that filament support wires 17,19 are in a common plane coincident with the principal plane of the lamp base. The principal or major plane of base 13 is generally coincident with the line of action of the principal vibratory force such that the base provides a strong anchorage for wires 17,19.

Obviously, numerous modifications and variations of the present invention are possible in the light of the above teachings. It is therefore to be understood that within the scope of the appended claims, the invention may be practiced otherwise than as specifically described herein.

What is claimed is:

1. A vehicle signal lamp assembly, comprising:

a lamp having a housing that includes a bulb and a base having generally flat opposed major side portions and opposed end portions, at least one pair of relatively stiff filament support wires embedded in said base to extend within the bulb, and a filament supported between the support wires in each said pair of support wires;

a rigid dielectric socket having a cavity receiving said lamp base, said cavity defining a first pair of opposed rigid internal dielectric side wedge surfaces diverging upwardly from a bottom portion of said cavity for engaging and securing said major side portions of said base within said socket, and a second pair of rigid internal dielectric side wedge surfaces for preventing side to side movement of said base within said socket whereby said lamp can be securely plugged into and removed from said socket;

electrical contacts disposed within said cavity and resiliently biased toward said major side portions of said lamp base; and a resilient elastomeric mounting supporting said socket, whereby said socket and associated lamp are partially isolated from vibratory forces exerted through said resilient mounting.

2. The signal lamp assembly of claim 1, wherein said lamp assembly is oriented so that each said filament has a length dimension coinciding approximately with a vertical line of action of a principal vibratory force exerted against said resilient mounting, whereby the filament is largely free from transverse bending forces.

3. The signal lamp assembly of claim 1, wherein each filament support wire comprises a U-shaped mounting portion embedded in said base with one leg of the U being enclosed within said base and with the other leg of the U being exposed along one of said flat opposed side portions of said base.

4. The signal lamp assembly of claim 3, wherein said electrical contacts are mounted within said dielectric socket adjacent each of said flat opposed major side portions and engage said filament support wires.

5. The signal lamp assembly of claim 4, wherein said electrical contacts comprise U-shaped resilient contact leaf elements having a deflectable arm engageable with the lamp base.

6. The signal lamp assembly of claim 1, and further comprising a collar encircling said lamp base, said collar having an abutment thereon limiting insertional movement of the lamp base into said cavity, and a resilient detent carried by said socket for gripping said collar when said lamp base is fully plugged into said cavity.

7. The signal lamp assembly of claim 1, wherein said resilient mounting comprises a one-piece elastomeric member that comprises two spaced parallel anchorage bars, a sleeve located midway between said anchorage bars, and compressible struts extending between said sleeve and said anchorage bars; said sleeve fitting around said rigid socket to support said socket in spaced relation to said anchorage bars.

8. The signal lamp assembly of claim 1, wherein said socket comprises a rigid enclosure formed of a nonconducting plastic material; said rigid enclosure having two open ends and internal side surfaces defining said cavity; said electrical contacts comprising spring leaf electrical contacts mounted in said cavity for engagement with said filament support wires when said lamp base is inserted into the cavity; lead wiring attached to said spring leaf contacts; and a deflectable latch carried by said spring leaf contacts; said rigid enclosure having internal shoulders in registry with said deflectable latch to prevent removal of said spring leaf contacts from said cavity.

* * * * *